US005381573A

United States Patent [19]

MacSanz

[11] Patent Number: 5,381,573

[45] Date of Patent: Jan. 17, 1995

[54] AUTOMATIC INVALID RELIEF FACILITY

[76] Inventor: Jossy MacSanz, 6815 ½ Fishburn Ave., Bell, Calif. 90201

[21] Appl. No.: 961,899

[22] PCT Filed: Dec. 27, 1991

[86] PCT No.: PCT/US91/09818

§ 371 Date: Sep. 20, 1993

§ 102(e) Date: Sep. 20, 1993

[87] PCT Pub. No.: WO93/12751

PCT Pub. Date: Jul. 8, 1993

[51] Int. Cl.[6] ..... A61G 7/02

[52] U.S. Cl. ..... 5/604; 5/463; 4/465; 4/480

[58] Field of Search ..... 5/604, 605, 463; 297/192; 4/450, 465, 480, 483

[56] References Cited

U.S. PATENT DOCUMENTS 557,614 4/1896 Schmitt .
2,591,850 4/1952 Mitchell .
3,922,735 12/1975 Kato .
4,011,610 3/1977 Parker .
4,571,759 2/1986 Sasaki et al. .
4,631,762 12/1986 Fugett .
5,008,964 4/1991 Dean et al. .
5,077,845 1/1992 Tokunaga et al. ..... 5/605

*Primary Examiner*—Michael F. Trettel
*Attorney, Agent, or Firm*—Paul H. Ware

[57] ABSTRACT

The object of the invention is to provide a facility that permits invalids and other movement-restricted persons to independently attend to the business of the elimination of body wastes and without the necessity of being removed from the vehicle of confinement, be it a bed, wheelchair or other structure. The facility has a waste receptacle (48) that may be moved into registry with an annular aperture (20) in a mattress (12) so as to receive body wastes in the receptacle. The facility also has a plug (14) that may be moved into position into said annular aperture for the comfort of the user. Both the mattress and the plug are provided with cleanable, removable covers (15) and (202).

12 Claims, 5 Drawing Sheets 10
12
14
16
18
20
22
24
26
28
30
32
34
36
37
38
40
46
52
54
56
58
60
62
64
66
2
2

AUTOMATIC INVALID RELIEF FACILITY

TECHNICAL FIELD

This invention relates to automatic facilities for the independent use of invalids and other movement-restricted persons or any other user conventionally needing the assistance of hospital or home-care personnel whenever the person so movement-restricted finds it necessary to answer a call of nature in the elimination of body wastes. In the operation of such facilities, it is essential that the body wastes, of whatever nature, be either automatically removed to sewage outlets as soon as possible after the invalid or other movement-restricted person has made a deposit of such waste matter, or that an attendant be alerted immediately to the need to dispose of such body wastes. It is also important that the process of body waste elimination be carried out cleanly and with a minimum of discomfort to the user.

BACKGROUND ART

The prior art includes U.S. Pat. No. 127,070, to C. G. Kuhn for *Improvement in Invalid-Bedsteads,* issued May 21, 1872. The device described in the Kuhn patent provides what the specification calls ". . . a false underbottom . . . sufficient to contain and conceal the mechanism of the apparatus." Kuhn further provides an inclined footrest that allows a movable part of the bottom to swing past it into the configuration shown in FIG. 1 thereof. Much of the mechanism is employed to manually raise and lower a headboard or back for the user's comfort. The manually operated mechanism also arranges the positioning of a commode by means of a "vibrating arm" into and out of registry with a commode-opening, which opening is provided with a yielding cushion which acts as a cover to close the commode when it is brought under the cushion.

Another prior art device is described in the U.S. Pat. No. 1,100,303, granted to Hooper for *Bed Attachment,* issued Jun. 16, 1914. The main object is recited to provide ". . . a device . . . which will eliminate the necessity of the patient being removed from the bed during the period of defecation." Hooper provides a carriage on wheels, completely removable from the bed, which carriage carries a chamber-pot, registrable beneath an opening in the mattress and having a sleeve and collar arrangement. The opening may be covered by means of a countersunk handle insertable from above the mattress.

Yet another prior art device has been illustrated in the U.S. Pat. No. 1,869,036, granted to Zink and issued Jul. 26, 1932, for *Sanitary Bedpan.* The primary object recited in the specification is stated ". . . to provide a bed pan connected with a sewer or standpipe whereby water may be supplied to the bed pan for flushing the same and carrying the waste matter from the pan to the sewer." In this innovation, the bed pan rests on the surface of the bed when in use and swivels outwardly therefrom when not being used.

U.S. Pat. No. 2,418,259, granted to Harmanson for *Hospital Bed Construction* and issued Apr. 1, 1947, describes another prior art device offering relief to invalids and other bedridden persons. The device makes use of bed slats to support a closet bowl that has a flange arranged to rest on the slats. Inlet water is provided from the water supply system of the building for the purpose of flushing and connection is made to the sewer system for the disposal of waste material.

Patentee St. Jean's U.S. Pat. No. 4,096,594, for *Mattress Device,* granted Jun. 27, 1978, while applicable both to a bed and a chair, appears to contemplate relief in no other cases than urination. The "mesh material" supports the weight of the incontinent person and permits ". . . liquid to flow therethrough."

A final prior art patent discovered in applicant's pre-examination novelty search is U.S. Pat. No. 4,631,762, and was granted to Fugett on Dec. 30, 1986, for *Hospital Bed with Toilet Facility.* The patent describes a facility that provides powered means to laterally slide a central mattress section aside and then to raise a waste-receiving receptacle into position for an invalid to use. After use, the system may be flushed and returned to its not-in-use position.

These prior art devices are commendable and show a creative spirit for their times. The inventors and their inventions have contributed remarkably to the technology involved. However, these prior art structures do not include those combined elements of the instant invention that provide greater facility of use and ingenious arrangement of components and that make the instant invention the high culmination in the art.

DISCLOSURE OF INVENTION

In accordance with the instant invention, there is provided a facility by means of which an invalid or other movement-restricted or confined person may independently attend to the necessary elimination of body wastes without leaving the vehicle of confinement whether it be bed, wheel chair or other vehicle. In the accomplishment of the aims and objects of the invention, a first easily movable embodiment includes a means of detection and provides an alarm signal giving notice that the facility has been used for the deposit of waste matter. The waste matter may then be removed by an attendant upon discovery of the alarm signal. Stained or otherwise soiled covers may be removed for cleaning and replaced with pre-cleaned covers. In another, more elaborate yet non-transportable embodiment, the device is autonomous in providing for the removal of the waste matter through an existing sewer system by means of the cooperation of the elements of the system itself.

BRIEF DESCRIPTION OF DRAWINGS

Further advantages and features of the instant invention will be more fully apparent to those skilled in the art to which the invention pertains from the ensuing detailed description thereof, regarded in conjunction with the accompanying drawings wherein like reference numerals refer to like parts throughout and in which.

BEST MODE FOR CARRYING OUT THE INVENTION

Figures 1, 2:
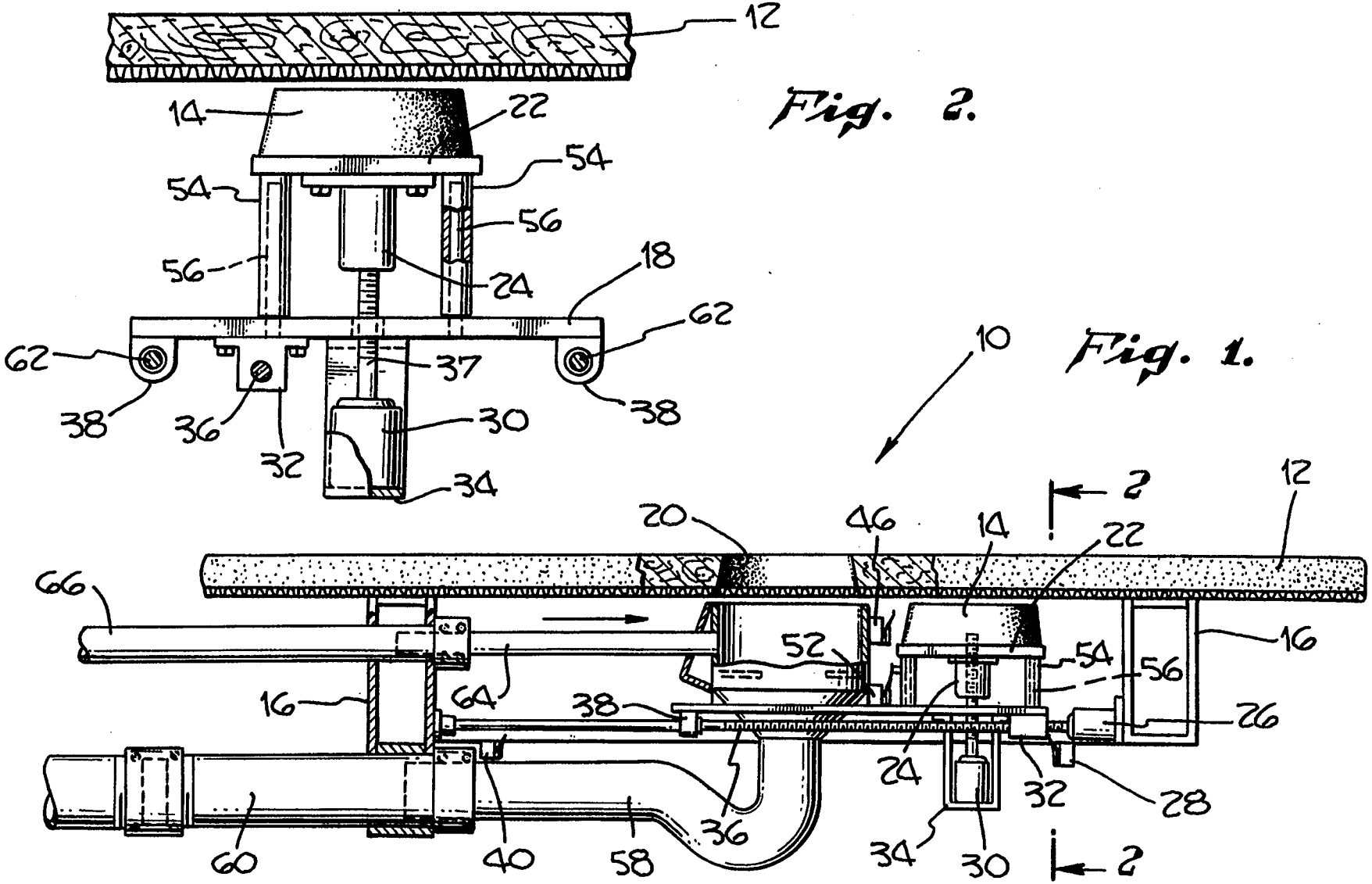
FIG. 1 is a side elevational view of the invention in its more elaborate form including means for disposal of the deposited waste matter into a sewer, the device being shown in configuration for use to deposit body wastes by an invalid or other movement restricted person.
FIG. 2 is a fragmentary, enlarged, cross-sectional view taken along the sight lines 2—2 of FIG. 1.
Figure 3:
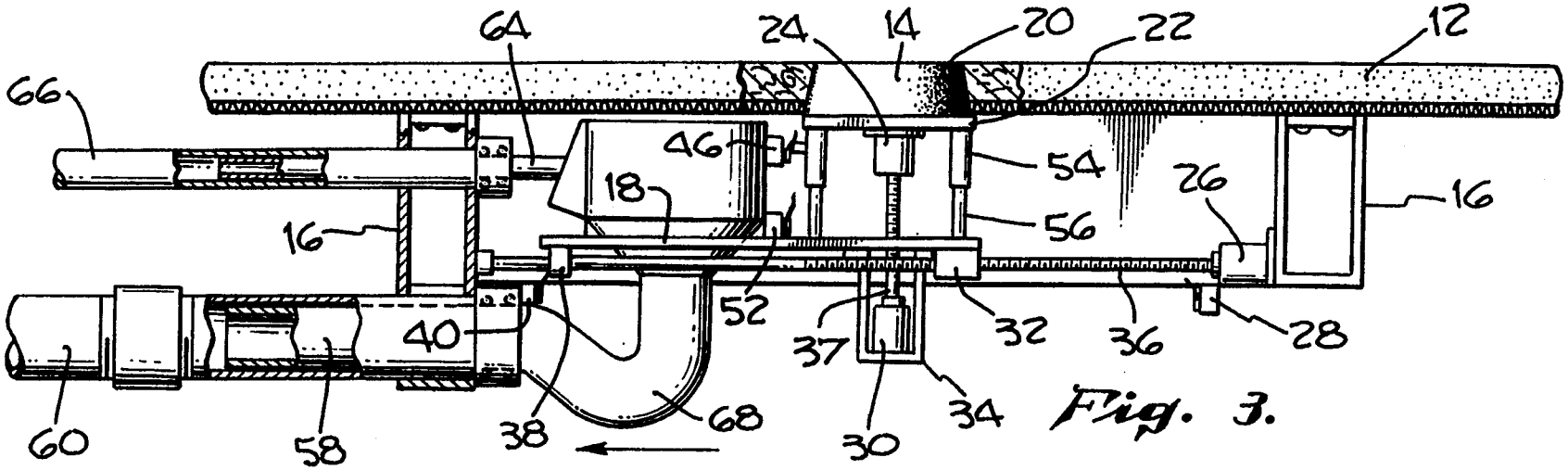
FIG. 3 is a side elevational view of the invention much like FIG. 1 except in the configuration shown, the device is depicted in its normal or not-in-use configuration.
Figure 4:
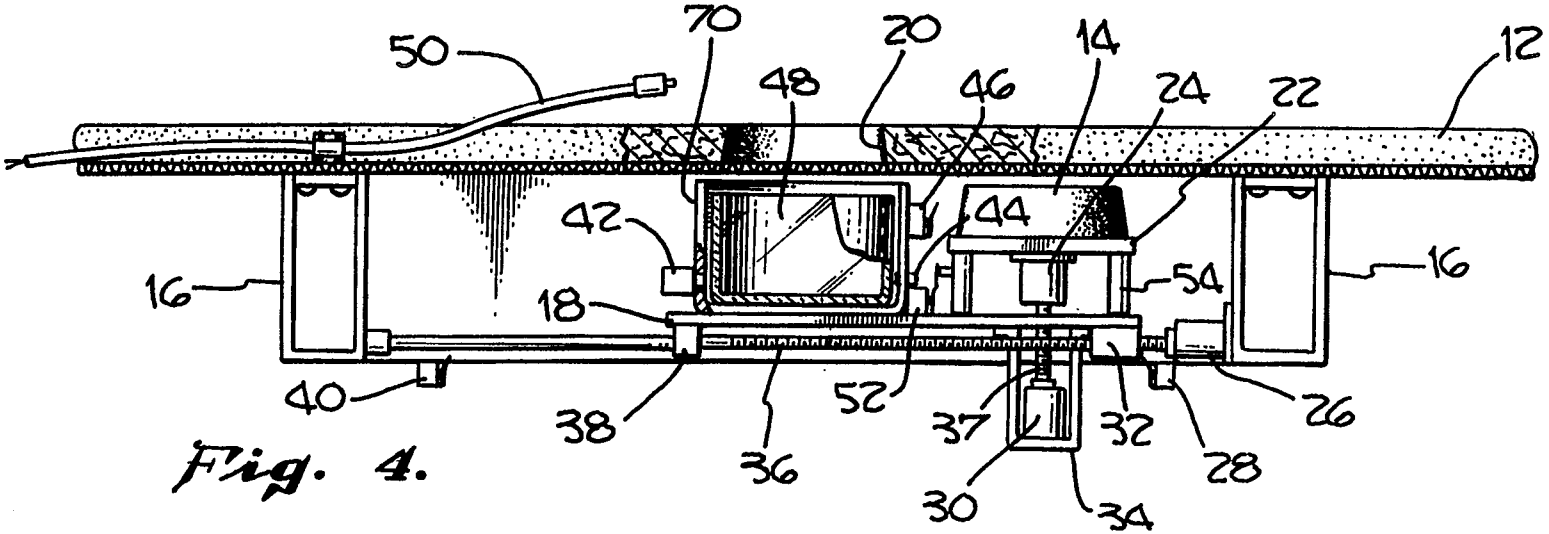
FIG. 4 is a side elevational view of the device in its simpler form wherein, after use, provision must be made to indicate that such use has occurred and that attendance is required for the disposal of deposited body wastes.
Figure 11:
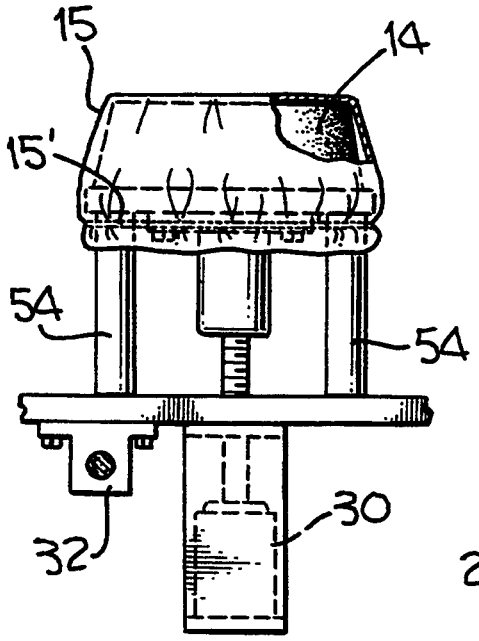
FIG. 11 is a fragmentary view of the removable cleanable cover applied to an element of the device.

Referring to the drawing and to FIGS. 1 through 4 with greater particularity, the Automatic Invalid Relief Facility is denoted generally by the numeral 10 and comprises a mattress 12 having a substantially central annular aperture 20 that may be in the form of a modified frustum of a cone. Said modified frustum may be so modified or shaped as to form an elongated, ovate opening having an upper circumferential contour of smaller dimensions than its lower, likewise symmetrically shaped circumferential contour. Said central annular aperture thus forming an opening into which a vertically movable plug 14, which is a solid surface in the form of a like-shaped, modified frustum of a cone, may be inserted, said plug 14 being of such dimensions as to fit snugly into said central annular aperture. The plug 14 may be covered by means of a suitable removable, washable or otherwise cleanable cover 15 having a means of securing that may be simply an elastic band 15' (FIG. 11). The plug 14, which may be fabricated of a suitable resilient material, rests on a solid base 22 which in turn is connected to and rests upon a horizontally movable carriage 18 by means of the rod and sleeve 56 and 54 respectively. Rod and sleeve structure 56 and 54 operate to maintain the orientation and the vertical positional integrity of plug 14. The plug base 22 is also attached by way of threaded shaft 37, one end of which is connected to a reversible electric motor 30 mounted within a bracket 34. The other end of said threaded shaft 37 is secured to said plug base 22 by means of a nut 24. Reversible electric motor 30, acting through threaded shaft 37, serves to vertically raise and lower said plug 14 up into and out of positional agreement with said aperture 20. The whole assembly just described is supported upon horizontally movable carriage 18 which is itself supported upon journal rods 62 which move horizontally upon linear bearings 38. Horizontally movable carriage 18 is caused to move horizontally by means of reversible electric motor 26 which drives threaded shaft 36 through nut 32 so as to place waste matter receptacle 48 into and out of horizontal registry with annular aperture or hole 20. The whole assembly just described, is supported by frame 16. A first limit switch 40 restricts and controls the extent of horizontal travel enjoyed by horizontally movable carriage 18 and arrests its leftward movement at the location of the limit switch as shown in FIGS. 1, 3 and 4. A second limit switch 28 serves a like purpose to restrict and control the extent of horizontal travel enjoyed by horizontally movable carriage 18 and to arrest its rightward movement at the location of the limit switch, also as shown in FIGS. 1, 3 and 4. The vertical travel of plug 14 is likewise controlled in extent by limit switches. A third limit switch 46 restricts and controls the extent of vertically upward travel allowed to plug 14, while a fourth limit switch 52 restricts and controls the extent of vertically downward travel of plug 14. Thus first and second limit switches 40 and 28 respectively restrict and control the extent of horizontal travel of horizontally movable carriage 18, while third and fourth limit switches 46 and 52 respectively restrict and control the extent of the vertical travel of plug 14 into and out of annular aperture 20.

Figure 8:
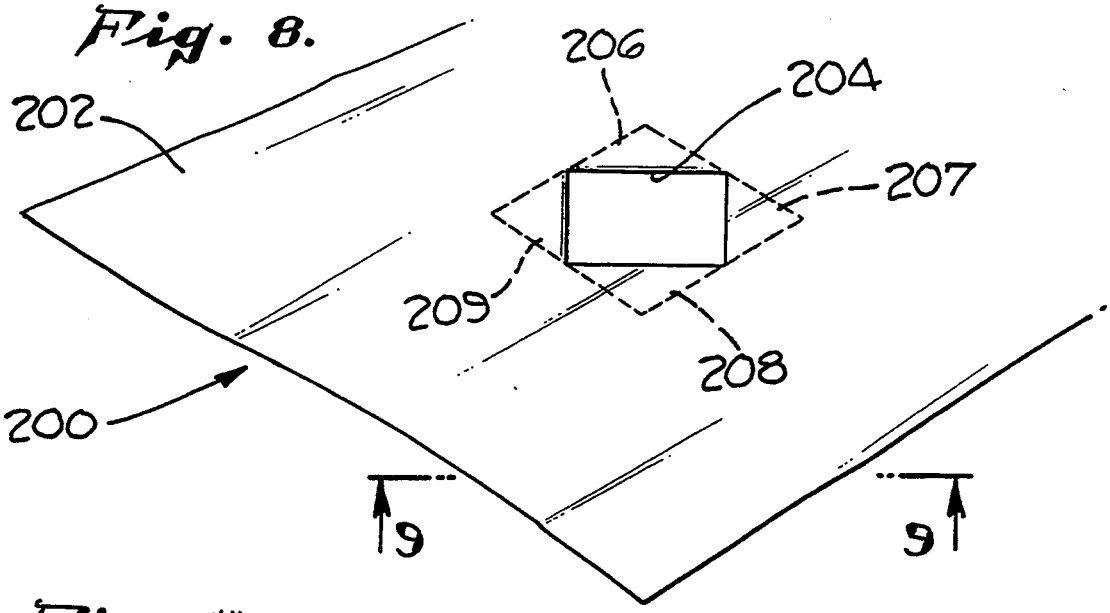
FIG. 8 is a perspective view showing the cover that may be removed for purposes of cleaning and showing the opening intended to communicate with the waste disposal facility.
Figure 9:
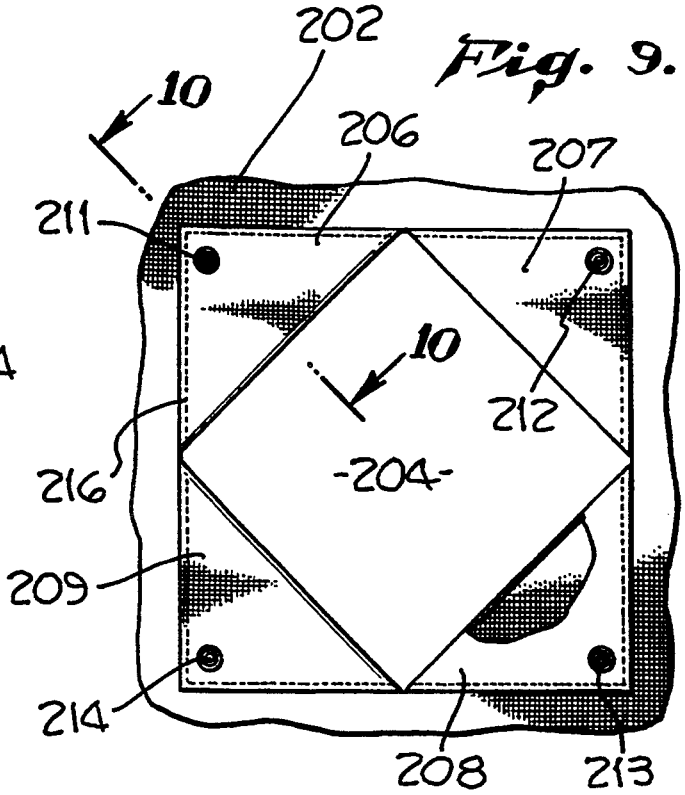
FIG. 9 is an enlarged, detailed view taken along the sight lines 9—9 of FIG. 8.
Figure 10:
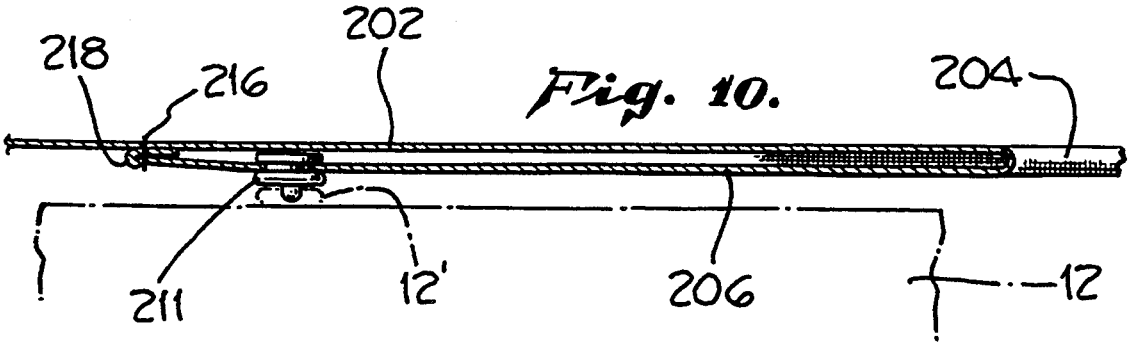
FIG. 10 is an enlarged, detailed view taken along the sight lines 10—10 of FIG. 9.

FIGS. 8, 9 and 10 depict a removable, cleanable mattress cover 202 within the general contemplation of a specialized bed sheet or the like, to be applied to the mattress 12. The cover for the mattress 12 is denoted generally by the numeral 200 and comprises a mattress cover 202 having a substantially central opening 204 which may be fashioned by forming a double slit so as to form an "X" in the fabric of the cover thus forming flaps 206, 207, 208 and 209 which may be pulled back so as to create the opening 204. Said opening 204 is designed to permit communication with annular aperture or opening 20 in the mattress 12. Means to secure said flaps 206, 207, 208 and 209 from the opening 204 may be implemented through the employment of snap fasteners 211, 212, 213 and 214, for example, as illustrated in FIG. 9. Means to create the opening as at numeral 204 and to secure the fabric of the mattress cover are deemed to be within the spirit, scope and contemplation of the invention. Reinforcement stitching is denoted generally by the numeral 216. Enlarged detail of the folding back of a representative flap 206 is shown in FIG. 10 wherein flap 206 has been shown folded back from opening 204 and fastened underneath mattress cover 202. As portrayed in the Figure, the flap 206 is folded back at the opening 204 and is secured underneath mattress cover 202 by means of the snap fastener system comprising female snap fastener element 12', which is secured to mattress 12, and male snap fastener element 211. Said fastener element 12' being mated with male snap fastener element 211 which is shown secured to flap 206. Reinforcement stitching 216 may be applied to a turn or foldunder 218 in the fabric of mattress cover 202. Such additional reinforcement stitching or other reinforcement measures should be considered to be within the spirit, scope and contemplation of the invention.

In the embodiment of the invention illustrated by FIGS. 1 and 3, the receptacle 48 is connected to a domestic water supply by means of telescoping water inlet pipe assembly comprising the telescoping pipes 64 and 66 by means of suitable pressure-reducing and flushing valves, not shown because such water supply and flushing arrangements are well known in the art and do not form an inventive part of the instant invention. In like manner, the receptacle 48 has a bottom outlet opening and is connected to telescoping tubes 58 and 60 through a trap 68 and thence to a domestic sewer inlet not shown. As in the water supply arrangement, telescoping tubes for the purpose of sewage disposal are old in the art and are not to be regarded as inventive elements in the instant invention.

Figure 5:
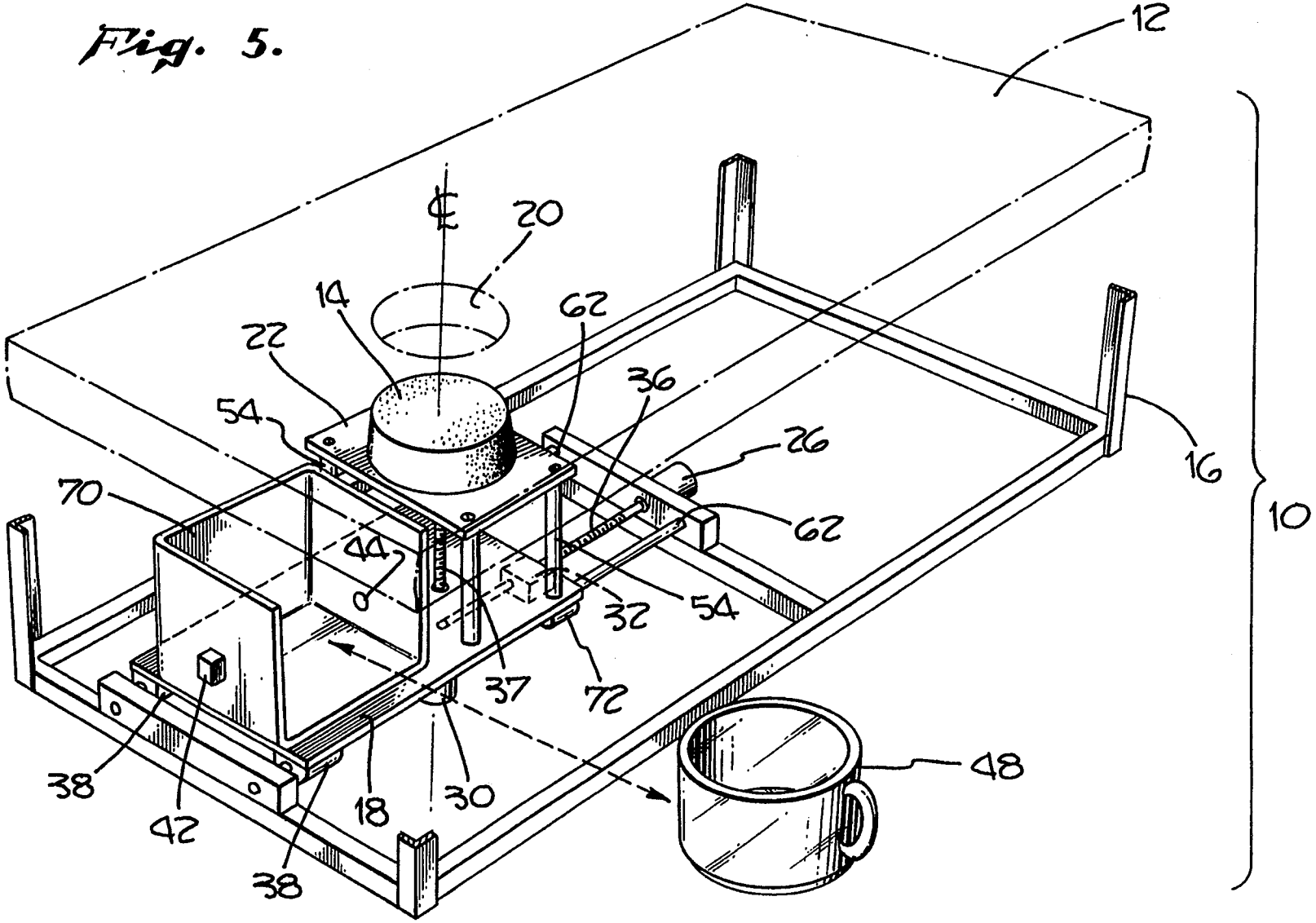
FIG. 5 is an exploded perspective view of the embodiment shown in FIG. 4.

In the embodiment shown in FIGS. 4 and 5, receptacle 48 is transparent, removable and is carried by receptacle holder 70 upon horizontally movable carriage 18. A photoelectric cell 42 is sensitive to a light 44 and through this sensitivity, causes an alarm signal, not shown because such alarm systems are well known in the art and do not form an inventive part of the instant invention, to become energized and active whenever a deposit has been made in receptacle 48. An electric control cable 50 having a forward/reverse switch is included to indicate that movement within and of the assembly is intended to be within the control of the invalid user. Such user operated control systems are well known and implemented in the prior art. An additional linear bearing 72 is shown in FIG. 5 at the opposite end of carriage 18 from linear bearing 38.

Figure 6:
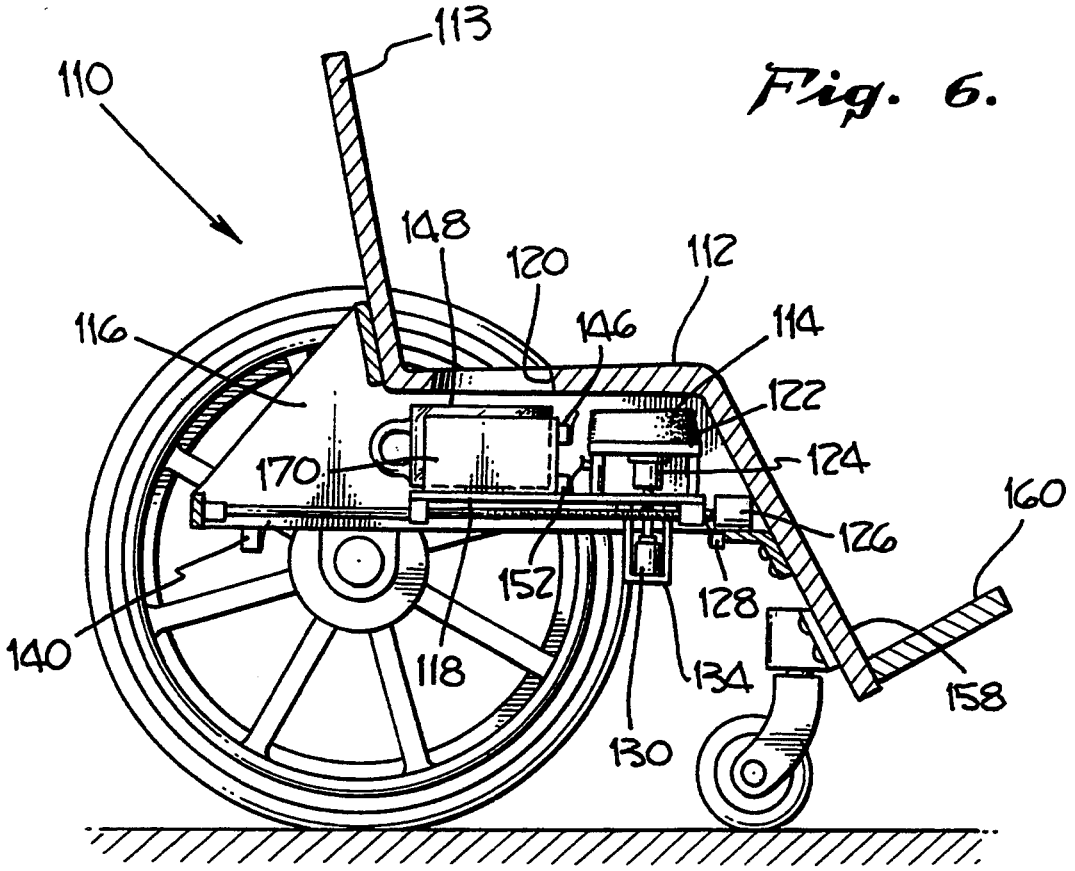
FIG. 6 shows the simpler embodiment of the invention in its in-use configuration, applied to a wheelchair as the vehicle of confinement of an invalid or other movement-restricted person.
Figure 7:
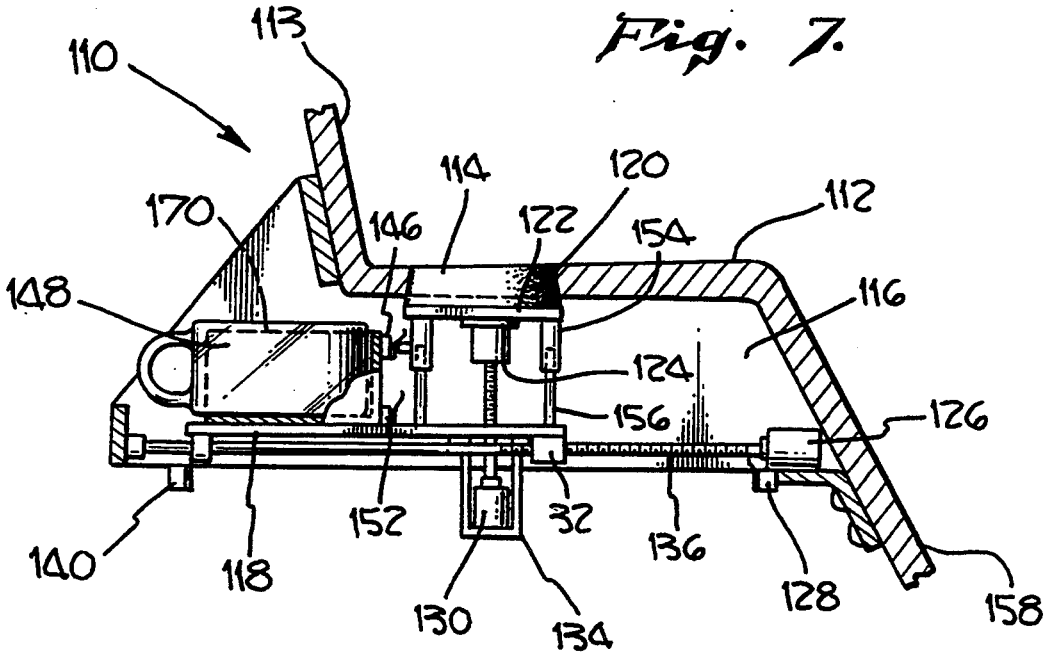
FIG. 7 is a fragmentary representation, much like FIG. 6, however, shown in the not-in-use configuration.

Attention is now invited to FIGS. 6 and 7 showing the Automatic Invalid Relief Facility applied to a wheelchair. The wheelchair is identified generally by the numeral 110 having a back portion 113, a seat portion 112, an inclined leg-rest portion 158 and a foot rest portion 160. The seat portion 112 includes an annular aperture 120 of the same nature as the annular aperture 20 of FIG. 1. The same general type of covering is expected to be applied as has been depicted in FIGS. 8, 9 and 10. An associated plug 114 serves the same purpose, bears the same description and enjoys the same relationship as the plug 14 bears to the aperture 20 in FIG. 1. Again, the same general type of covering is expected to be applied as has been depicted in FIG. 11. In like manner, the plug 114 is supported by plug base 122 which is supported by a nut 124 attached to threaded shaft 137 which is driven by reversible motor 130 so as to vertically raise and lower said plug 114 within the constraints imposed by limit switches 146 and 152 and into and out of union with aperture 120. Sleeve and rod assembly comprising sleeve 154 and rod 156 provide vertical positional integrity for the plug and plug base 114 and 122 respectively. The reversible electric motor 130 is maintained in position by bracket 134. A receptacle or pot 148 is positioned by means of a receptacle or pot holder 170 from which the pot 148 can be removed by an attendant when circumstances warrant. A reversible electric motor 126 provides horizontal motion to a movable carriage 118 by driving threaded shaft 136 within the constraints imposed by limit switches 140 and 128 for the purpose of moving the receptacle 148 into and out of registry with aperture 120. A linear bearing 138 provides support and facilitates horizontal movement of the assembly. The supporting wheelchair frame is denoted by the numeral 116. The same photoelectric alarm system as has been described with respect to FIGS. 4 and 5 is expected to be a part of the system just described.

INDUSTRIAL APPLICABILITY

The present invention finds application wherever invalids and other movement-restricted persons receive care, either from a care provider other than the invalid or where such care is provided independently by the invalid.

I claim:

1. An automatic invalid relief facility for the independent use of invalids and other movement-restricted persons and other users, comprising:

a mattress having a central annular aperture;

a removable mattress cover having a substantially central opening, said opening adapted to communicate with said annular aperture in said mattress;

a transparent, removable waste receptacle registrable with said central annular aperture for receiving body waste deposits from a user;

a waste receptacle holder for receiving and supporting said waste receptacle;

a vertically movable plug of such dimensions as to be inserted and to fit snugly into said central annular aperture;

a cleanable cover securable over said plug;

a horizontally movable carriage for moving said waste receptacle and said plug into and out of registry with said central annular aperture;

horizontal motive means for moving said horizontally movable carriage;

vertical motive means for moving said vertically movable plug into and out of said central annular aperture when said vertically movable plug has been placed in registry therewith by said horizontal motive means;

sensing and alarm signal means for alerting attendant personnel that a deposit has been made by a user into said body waste receptacle; and user operated control means for operating said motive means.

2. The device of claim 1 in which said horizontal motive means comprises:

journal rods supporting said horizontally movable carriage;

linear bearings supporting and retaining said journal rods and providing low-friction travel for said horizontally movable carriage along said journal rods;

a first limit switch operable to arrest the horizontal travel of said horizontally movable carriage in one horizontal direction along said journal rods;

a second limit switch operable to arrest the horizontal travel of said horizontally movable carriage in the opposite horizontal direction along said journal rods;

a threaded shaft drivingly attached to said horizontally movable carriage; and a reversible electric motor for driving said threaded shaft in said one horizontal direction and in said opposite horizontal direction along said journal rods.

3. The device of claim 1 in which said vertical motive means comprises:

a sleeve attached at one end to said vertically movable plug;

a rod situated longitudinally within said sleeve and attached at one of its ends to said horizontally movable carriage;

a threaded shaft attached at one end to said vertically movable plug; and a reversible electric motor attached to the other end of said threaded shaft for driving said threaded shaft in one vertical direction and in the opposite vertical direction so as to move said plug in said vertical directions.

4. An automatic invalid relief facility for the independent use of invalids and other movement-restricted persons and other users, comprising:

a mattress having a central annular aperture;

a removable mattress cover having a substantially central opening, said opening adapted to communicate with said annular aperture in said mattress;

a waste receptacle having a bottom outlet opening registrable with said central annular aperture for receiving body waste deposits from a user;

water supply means for supplying water from a domestic water system to flush waste from said waste receptacle through said bottom outlet opening;

sewer inlet means communicating with said bottom outlet opening for receiving said body wastes into a domestic sewer facility;

a vertically movable plug of such dimensions as to be inserted and to fit snugly into said central annular aperture;

a cleanable, removaable cover securable over said plug;

a horizontally movable carriage for moving said waste receptacle and said plug into and out of registry with said central annular aperture;

horizontal motive means for moving said horizontally movable carriage;

vertical motive means for moving said vertically movable plug into and out of said central annular aperture when said vertically movable plug has been placed in registry therewith by said horizontal motive means; and user operated control means for operating said motive means.

5. The device of claim 4 wherein:

said water supply means includes telescoping tubes;

said sewer inlet means includes telescoping tubes;

and in which said horizontal motive means comprises:

journal rods supporting said horizontally movable carriage;

linear bearings supporting and retaining said journal rods and providing low-friction travel for said horizontally movable carriage along said journal rods;

a first limit switch operable to arrest the horizontal travel of said horizontally movable carriage in one horizontal direction along said journal rods;

a second limit switch operable to arrest the horizontal travel of said horizontally movable carriage in the opposite horizontal direction along said journal rods;

a threaded shaft drivingly attached to said horizontally movable carriage; and a reversible electric motor for driving said threaded shaft in said one horizontal direction and in said opposite horizontal direction along said journal rods.

6. The device of claim 4 in which said vertical motive means comprises:

a sleeve attached at one end to said vertically movable plug;

a rod situated longitudinally within said sleeve and attached at one of its ends to said horizontally movable carriage;

a threaded shaft attached at one end to said vertically movable plug; and a reversible electric motor attached to the other end of said threaded shaft for driving said threaded shaft in one vertical direction and in the opposite vertical direction so as to move said plug in said vertical directions.

7. An automatic invalid relief facility applied to a wheelchair for the independent use of invalids and other movement-restricted persons and other users, comprising:

a seat portion of said wheelchair having a central annular aperture;

a removable cover having a substantially central opening, said opening adapted to communicate with said central annular aperture in said seat portion of said wheelchair;

a transparent, removable waste receptacle registrable with said central annular aperture for receiving body waste deposits from a user;

a waste receptacle holder for receiving and supporting said waste receptacle;

a vertically movable plug of such dimensions as to be inserted and to fit snugly into said central annular aperture;

a cleanable, removable cover securable over said plug:

a horizontally movable carriage for moving said waste receptacle and said plug into and out of registry with said central annular aperture;

horizontal motive means for moving said horizontally movable carriage;

vertical motive means for moving said vertically movable plug into and out of said central annular aperture when said vertically movable plug has been placed in registry therewith by said horizontal motive means;

sensing and alarm signal means for alerting attendant personnel that a deposit has been made by a user into said body waste receptacle; and user operated control means for operating said motive means.

8. The device of claim 7 in which said horizontal motive means comprises:

journal rods supporting said horizontally movable carriage;

linear bearings supporting and retaining said journal rods and providing low-friction travel for said horizontally movable carriage along said journal rods;

a first limit switch operable to arrest the horizontal travel of said horizontally movable carriage in one horizontal direction along said journal rods;

a second limit switch operable to arrest the horizontal travel of said horizontally movable carriage in the opposite horizontal direction along said journal rods;

a threaded shaft drivingly attached to said horizontally movable carriage; and a reversible electric motor for driving said threaded shaft in said one horizontal direction and in said opposite horizontal direction along said journal rods.

9. The device of claim 7 in which said vertical motive means comprises:

a sleeve attached at one end to said vertically movable plug;

a rod situated longitudinally within said sleeve and attached at one of its ends to said horizontally movable carriage;

a threaded shaft attached at one end to said vertically movable plug; and a reversible electric motor attached to the other end of said threaded shaft for driving said threaded shaft in one vertical direction and in the opposite vertical direction so as to move said plug in said vertical directions.

10. An automatic invalid relief facility comprising:

a mattress having a central annular aperture;

a removable waste receptacle registrable with said central annular aperture for receiving body waste deposits from a user;

a vertically movable plug of such dimensions as to be inserted and to fit snugly into said central annular aperture;

a horizontally movable carriage for moving said waste receptacle and said plug into and out of registry with said central annular aperture;

horizontal motive means for moving said horizontally movable carriage; and vertical motive means for moving said vertically movable plug into and out of said central annular aperture when said vertically movable plug has been placed in registry therewith by said horizontal motive means.

11. The device of claim 10 in which said horizontal motive means comprises:

journal rods supporting said horizontally movable carriage;

linear bearings supporting and retaining said journal rods and providing low-friction travel for said horizontally movable carriage along said journal rods;

a first limit switch operable to arrest the horizontal travel of said horizontally movable carriage in one horizontal direction along said journal rods;

a second limit switch operable to arrest the horizontal travel of said horizontally movable carriage in the opposite horizontal direction along said journal rods;

a threaded shaft drivingly attached to said horizontally movable carriage; and a reversible electric motor for driving said threaded shaft in said one horizontal direction and in said opposite horizontal direction along said journal rods.

12. The device of claim 10 in which said vertical motive means comprises:

a sleeve attached at one end to said vertically movable plug;

a rod situated longitudinally within said sleeve and attached at one of its ends to said horizontally movable carriage;

a threaded shaft attached at one end to said vertically movable plug; and a reversible electric motor attached to the other end of said threaded shaft for driving said threaded shaft in one vertical direction and in the opposite vertical direction so as to move said plug in said vertical directions.

* * * * *